US005092312A

United States Patent [19]

Zolow

[11] Patent Number: 5,092,312

[45] Date of Patent: Mar. 3, 1992

[54] FIREPLACE WITH WATER FOUNTAIN

[76] Inventor: Jack Zolow, 1700 Irving Park Rd., Chicago, Ill. 60613

[21] Appl. No.: 613,402

[22] Filed: Nov. 15, 1990

[51] Int. Cl.[5] ..... F24B 1/18

[52] U.S. Cl. ..... 126/500; 126/85 R; 126/508; 239/18; 239/20

[58] Field of Search ..... 126/500, 508, 512, 116 R, 126/113, 85 R, 86, 92 R, 144; 362/362, 253, 145; D23/201; 431/125

[56] References Cited

U.S. PATENT DOCUMENTS 2,503,945 4/1950 Grossniklaus ..... 126/508 X
2,705,488 4/1955 Wright ..... 126/508
4,167,177 9/1979 Wiggins ..... 126/508 X
4,241,719 12/1980 Vickery ..... 126/508 X
4,858,826 8/1989 Robinson ..... 239/18

FOREIGN PATENT DOCUMENTS 2902595 7/1980 Fed. Rep. of Germany ..... 126/508

*Primary Examiner*—Larry Jones
*Attorney, Agent, or Firm*—Laff, Whitesel, Conte & Saret

[57] ABSTRACT

A fireplace structure has a water fountain in at least the front part of a fire box having a gas burner therein. The structure may be either placed in a fireplace or free standing apart from any fireplace.

16 Claims, 1 Drawing Sheet

FIREPLACE WITH WATER FOUNTAIN

BACKGROUND OF THE INVENTION

This invention relates to fireplace equipment and more particularly to ornamental gas-fired equipment containing a fountain.

Fireplaces often include a device for burning gas, as distinguished from logs, coal, or other solid fuels. These gas burning devices usually have ornamental parts which disguise the gas burners. The most common of these ornamental parts are ceramic logs, stone, or the like. These parts do a good job of concealing the gas burner, but limit the ornamentation available from the view point of interior design.

Accordingly, an object of the invention is to provide new and improved ornamentation for gas-fired fireplaces. Here, an object is to provide such ornamentation without loss of the convenience of the gas-fired feature.

Another object of the present invention is to add humidity to the air which tends to become unduly dry during times when a fireplace is most likely to be used.

Still another object is to provide means for accomplishing these and other objects in houses which either do or do not have built-in fireplaces.

SUMMARY OF THE INVENTION

In keeping with an aspect of the invention, these and other objects are accomplished by providing a sheet metal hood and fire box which may be either inserted into a fireplace or stand alone for houses without fireplaces. Burners, including gas logs, or the like, may be mounted in the fire box. Surrounding the fire box is a moat or trough containing a number of water jets. The water issuing from these jets falls back and into a trough. Suitable pumps are provided to pump the water both through the jets, and if need be, to recycle water after it is recovered from the trough. Lights may be provided for lighting the water. Thus, a fountain may be provided to surround or otherwise decorate the fire box. All necessary safety features are built into the invention in order to meet local fire codes.

Preferred embodiments of the invention are shown in the attached drawings, in which:

DESCRIPTION OF A PREFERRED EMBODIMENT

Figure 1:
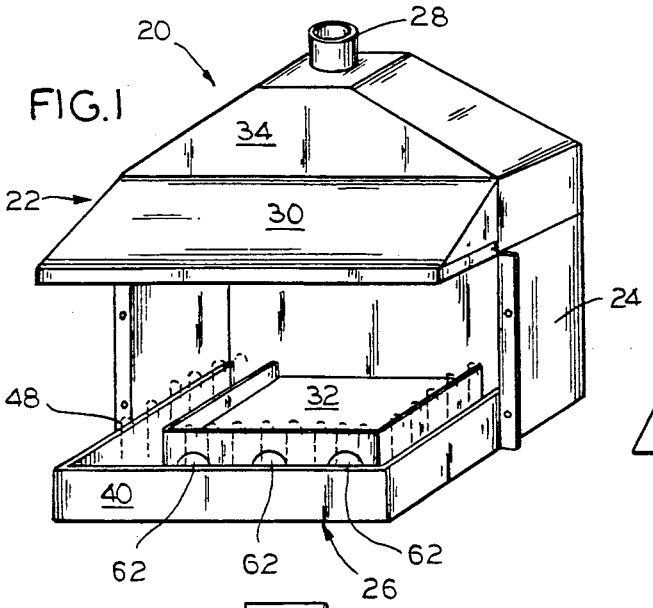
FIG. 1 is a perspective view of a free standing embodiment of the invention which may be installed in a house which does not have a built-in fireplace.

FIG. 1 shows a free standing embodiment 20 of the invention which may be installed in a house which does not have a built-in fireplace. The embodiment is made of heavy gauge sheet steel which is formed into a hood 22, back support 24, and fire box and fountain base assembly 26. A vent 28 may be connected to any suitable chimney.

The sheet metal may be fabricated into any of many different shapes depending upon the user's preferences. However, in general, it will include a canopy 30 covering the area above a fire box 32 in order to collect fumes generated by a fire in the fire box. The canopy 30 feeds into a plenum which guides and directs the fumes into the vent 28. The back 24 provides a mechanical support for the hood 30 and ties together the hood and base assembly 26 to complete a free-standing fireplace.

Figure 2:
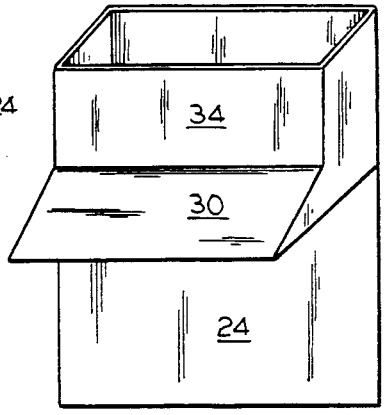
FIG. 2 is a perspective view of a hood which may be installed inside a fireplace built into a house.
Figure 3:
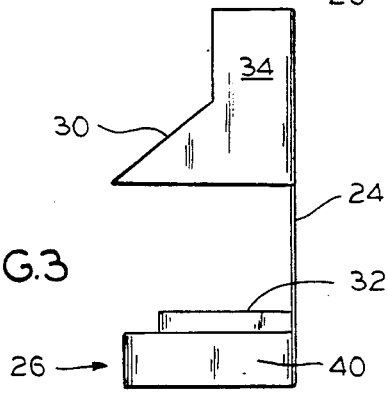
FIG. 3 is a side view of the hood of FIG. 2 with a fire box added.

In FIGS. 2, 3, the construction is similar to that of FIG. 1, except that the sheet metal is shaped to fit into a fireplace which may be built into a house. The same reference numerals are used to identify corresponding parts in FIGS. 1–3.

As seen in FIGS. 1 and 3, the fire box 32 is higher than a surrounding fountain assembly 40. Therefore, the heat that is generated by a gas burner resting on the top of fire box 32 is above the fountain assembly which remains cool enough not to boil the water that may be in the fountain, although the heat surrounding the water may be enough to evaporate some of the water and add humidity to the surrounding air.

Preferably suitable connections, not shown, are permanently connected into the base unit to supply gas, water, and a drain for the water. However, for those installations where water and drain connections may be awkward, the invention also contemplates a closed water system where a home owner pours water into and drains water from the fountain assembly.

Figure 4:
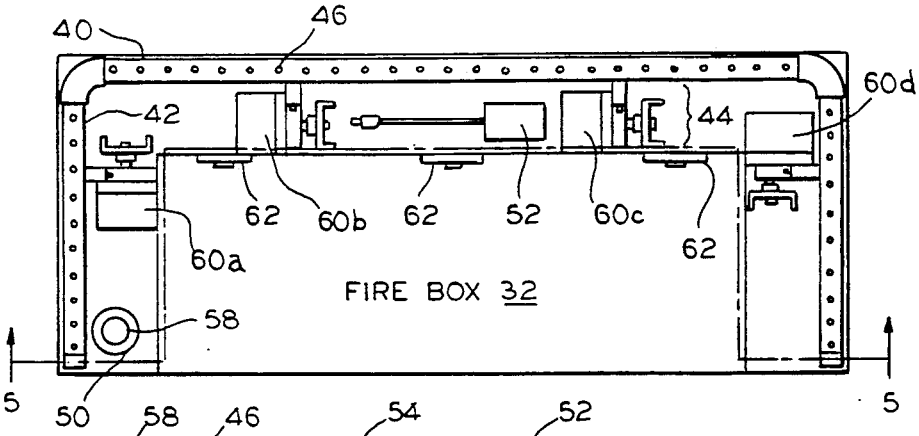
FIG. 4 is a plan view of the fire box and fountain provided by the invention.
Figure 5:
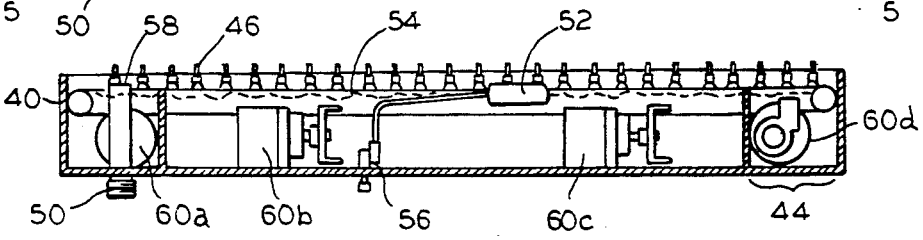
FIG. 5 is a cross-section taken along line 5—5 of FIG. 4.

The inventive fountain assembly 40 may be understood best from an inspection of FIGS. 4, 5. A preferably copper pipe 42 is fashioned in a form and shape which provides a water display that fits into the decor of the fountain assembly. As here shown, the decor calls for a pipe 42 in a generally "U" shape. The pipe fits into a U-shaped moat or trough 44 which partially surrounds the front and at least some of the opposite sides of the fire box 32. The moat is deep enough to contain all water which might be present and wide enough to collect all water that may be falling from the fountain spray.

The pipe 42 has any suitable number of holes found therein for receiving jet nozzles 46 designed to spray water in an upward direction. As here shown, nozzles are uniformly distributed along the length of the pipe, each nozzle being oriented to direct a stream of water or spray upwardly, as shown at 48 (FIG. 1) for example. Therefore, in this particular example (FIG. 4), a curtain of water jets surrounds three sides of the fire box. Of course, the pattern of water may be modified in any suitable manner to fit any suitable decor.

The moat or trough 44 includes a drain 50 (FIGS. 4, 5) through which water leaves the moat. A float 52 opens and closes valve 56 to control the lower level of water 54 in moat 44. The drain 50 has an overflow pipe 58 which controls the upper level of the water 54. If the water system is a closed circuit, the water flows to a collection point from which it is pumped back through the pipe 42. If the water is supplied from the house plumbing, drain 50 is connected into the house drainage system.

Any suitable number of underwater pumps 60 may be provided in order to control the height of the jet streams in the water display 48. Preferably, the pumps 60 are small enough to be concealed under the water within the moat 44. However, the invention also contemplates other arrangements such as placing the pumps under the fire box 32, or in another convenient location.

Each of these pumps preferably pressurizes a separate section of pipe 42. There should be enough pumps to maintain a desired height of the water display; that is, one does not normally want higher jet streams of water near the pump and lower jet streams on the remote end of pipe 42. Usually, the height of the jet streams are uniform around the perimeter of moat 44, although the display may be programmed in any desirable manner. For example, the pumps 60*b*, 60*c* could be adjusted to give a higher rise of water at the center and the pumps 60*a*, 60*d* could be adjusted to give a lower rise of water at the ends of the pipe 42. In a particularly fancy display, the pumps may be programmed to switch on and off to give either a continuously or an intermittently varying display or a combination thereof, for example. Pipe 42 could be duplicated or doubled in places to give a thicker sheet of water in some locations by turning on a second pump and the like.

Underwater lights 62 (FIGS. 1, 4)are built into the walls of the moat 44, at any convenient location. As here shown, there are three such lights in the back wall of the moat at the front of the display. The reflectors, sockets, wires, etc. for the lights (FIG. 4) may be in the space under the fire box 32 with only the lens in the moat wall. These lights may have suitable colored lens. The lamps may also have white lens with provisions for an installation of colored filters in front of the light bulb and behind the lens. This arrangement would enable the user to change the color of the light for special events, such as red and green for Christmas and yellow and purple for Easter. If the plumbing and gas pipe are permanently installed, the electrical power lines may also be permanently installed. If there is no permanent electrical connections, batteries may be used to light the lights.

If permanent electrical wiring is used, preferably a step down transformer is provided to reduce the voltage to a safe range, such as 5–12 volts. All safety precautions for underwater wiring are observed, such as the use of waterproof wires, sealing means at openings, waterproof pumps, lights, and the like.

Figure 6:
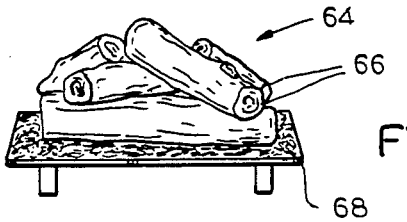
FIG. 6 is a perspective view of a gas burner, disguised by ceramic logs, for installation in the fire box.

After the installation of the base assembly 26 is completed, a conventional gas burner 64 (FIG. 6) is set upon the top of fire box 32 and connected to any suitable gas source. As here shown, the gas burner 64 has decoration in the form of ceramic logs 66 and embers 68. Of course, any other suitable decor may also be used for burner 64. For example, an attractive burner is merely a layer of ornamental stones with the gas flame dancing on top of the layer.

Those who are skilled in the art will readily perceive how to modify the invention. Therefore, the appended claims are to be construed to cover all equivalent structures which fall within the true scope and spirit of the invention.

I claim:

1. A fireplace fountain comprising a base assembly and a hood supported over said base assembly, said base assembly including a fire box and a moat peripherally surrounding at least a part of said fire box, means associated with said moat for giving a water display with the displayed water falling back into said moat, and means for circulating water through said display and into said moat.

2. The fountain of claim 1 wherein said water circulating means comprises at least one water pump in said moat for causing said display.

3. The fountain of claim 1 and a pipe carrying a plurality of nozzle means for giving said water display, said pipe being located in said moat, said water circulating means comprising at least one submersible water pump in said moat for pressurizing said water in said pipe to eject water from said nozzles and cause said display.

4. The fountain of either claim 2 or claim 3 and float means for controlling the level of water in said moat.

5. The fountain of either claim 2 or claim 3 wherein said fire box is at a level which is far enough above said water display to preclude boiling said water.

6. The fountain of either claim 2 or claim 3 and gas burner means located on said fire box.

7. The fountain of either claim 2 or claim 3 and underwater lighting means in said moat for lighting said display means.

8. The fountain of claim 7 wherein said lighting means includes means for displaying colored light.

9. The fountain of either claim 2 or claim 3 wherein the fountain is intended for use in a house, said fountain including means for supporting said base assembly and hood in a free standing mode apart from any specific structural aspect of the house.

10. The fountain of either claim 2 or claim 3 and means for supporting said base assembly and hood in a fireplace built into a house.

11. A fireplace structure comprising a sheet metal housing providing a base assembly with a hood over it, a moat in at least a part of the front of said base assembly, a pipe extending within said moat, a plurality of nozzles in said pipe for directing a plurality of water streams upwardly from said moat in a direction toward said hood, said moat having dimensions which catch and collect water falling back from said upwardly directed streams, means in said moat for controlling the level of water therein, and means including a gas burner on said base assembly and at a level which is higher than said upwardly directed water streams for displaying a fire behind said upwardly directed water streams.

12. The structure of claim 11 and means for programming said upwardly directed water in order to provide a selected water display.

13. The structure of claim 12 wherein said pipe is sectionalized and there is a separate pump for each section whereby said programmed water display results from separately controlling each of said pumps, either individually or in combination.

14. The structure of any one of the claims 11–13 and decorative means for covering said gas burner.

15. The structure of any one of the claims 11–13 and low voltage means for lighting said water display and said water level control means is a float valve.

16. An ornamentation for use with a fireplace, said ornamentation comprising a housing including at least a base assembly with an elevated fire box and a hood over it, a moat surrounding at least a front and a part of two sides of said fire box, a water pipe extending through and within said moat, a plurality of upwardly directed nozzles in said pipe for driving a plurality of water streams upwardly in a direction toward said hood, said pipe being sectionalized with a separate pump for pressurizing each section whereby said water display may be programmed by separately controlling each of said pumps, either individually or in combination, said moat having dimensions which catch and collect water falling back from said upwardly directed water streams, means comprising a float and a drain pipe in said moat for controlling the level of water therein, and means including a gas burner on said base assembly, such means being located at a level which is higher than said upwardly directed water streams for displaying a fire behind said upwardly directed water streams.

* * * * *